United States Patent [19]

Buxton et al.

[11] Patent Number: 4,686,642

[45] Date of Patent: Aug. 11, 1987

[54] METHOD AND APPARATUS FOR GENERATING A STROKE ON A DISPLAY

[75] Inventors: James L. Buxton, East Palo Alto; Alan C. Phillips, Los Altos; Stanley K. Honey, Newark, all of Calif.

[73] Assignee: Etak, Inc., Menlo Park, Calif.

[21] Appl. No.: 662,183

[22] Filed: Oct. 18, 1984

[51] Int. Cl.[4] ..... G06G 7/00; G06G 7/16

[52] U.S. Cl. ..... 364/607; 340/347 DA; 364/800; 364/851

[58] Field of Search ..... 364/607, 600, 602, 800, 364/801, 802, 851; 328/180, 181, 185; 307/106; 340/347 DA; 250/374

[56] References Cited

U.S. PATENT DOCUMENTS

| | | | |
|---|---|---|---|
| 3,413,453 | 11/1968 | Thorpe | 364/607 |
| 3,431,458 | 3/1969 | Christopher | 315/18 |
| 3,504,360 | 3/1970 | Vosbury | 340/347 |
| 3,646,549 | 2/1972 | Bryden | 340/347 |
| 3,659,282 | 4/1972 | Tada | 340/324 A |
| 3,800,183 | 3/1974 | Halio | 315/18 |
| 3,818,475 | 6/1974 | Hussey | 340/324 A |
| 3,959,653 | 5/1976 | Lee | 250/374 |
| 4,032,768 | 6/1977 | Rieger | 235/197 |
| 4,109,168 | 8/1978 | Raymond | 307/271 |
| 4,369,441 | 1/1983 | Wohlmuth | 340/733 |

*Primary Examiner*—E. A. Goldberg
*Assistant Examiner*—Mark Reinhart
*Attorney, Agent, or Firm*—Fliesler, Dubb, Meyer & Lovejoy

[57] ABSTRACT

A method and apparatus for generating a stroke on a display comprising a pair of pulse train generators coupled to a pair of charge pump and integrator assemblies by means of a switch assembly. In operation, a first pulse train corresponding to the larger of the X and Y components of the stroke and a second pulse train corresponding to the ratio of the X and Y components of the stroke control the magnitude of the output of the charge pump and integrator assemblies.

23 Claims, 4 Drawing Figures

METHOD AND APPARATUS FOR GENERATING A STROKE ON A DISPLAY

FIELD OF THE INVENTION

The present invention relates to alpha-numeric and graphic displays in general and to a method and apparatus for generating a stroke on an alpha-numeric or graphic display in particular.

BACKGROUND OF THE INVENTION

Alpha-numeric and graphic displays comprise a variety of methods and apparatus which typically fall within two general categories, e.g., dot matrix type displays and vector or stroke type displays.

Dot matrix type displays form alpha-numeric characters and graphic images by selectively illuminating, printing or otherwise making visible dots or pixels on a CRT screen, flat panel display, paper, or other recording medium. Depending on the density of the dots or pixels, an alpha-numeric character or graphic image on a dot matrix type display can appear, to an unaided eye, as a plurality of line segments. In contrast, an alpha-numeric character or graphic image on a vector or stroke type display does, in fact, comprise a plurality of line segments.

A stroke on a stroke type display, such as a CRT or pen recorder, is usually generated using analog signals, typically ramps, applied to X and Y controls. For example, in an electrostatic deflection CRT type stroke display, an electron beam is displaced from a zero potential position by the application of positive and negative potentials to X and Y electrodes. If the X electrode controls horizontal movement of the beam and the Y electrode controls vertical movement of the beam, a changing potential applied simultaneously to both the X and Y electrodes will produce a stroke on the CRT which has both an X component and a Y component. The magnitude and the polarity of the change of the X and Y potentials applied to the X and Y electrodes determine the length and slope of the stroke.

In a magnetic deflection CRT type stroke display an electron beam is deflected in an X and Y direction by the application of currents to the X and Y windings of a deflection yoke. Typically, the currents are provided by a voltage controlled current source coupled to the yoke.

In addition to the magnitude and polarity of the potentials applied to the X and Y electrodes in the electrostatic deflection CRT type stroke displays and the currents applied to the X and Y windings of the yoke in the magnetic deflection CRT type stroke displays, as described above, the rate of change of the potentials and currents applied to the X and Y electrodes and X and Y windings must also be taken into consideration in order to control the brightness or intensity of the stroke over its length. This is because a fast-moving electron beam over a given distance will produce a stroke of lesser intensity than a slower moving beam over the same distance. As a consequence of this phenomenon, CRT type stroke displays can use beam velocity to control intensity.

Heretofore, several proposals have been made for providing for beam movement. For example, stroke type displays with means for providing beam movement have included digital-to-analog converters (DAC) in combination with rate generators for generating the required deflection potentials, such as shown and described in U.S. Pat. No. 3,800,183 and U.S. Pat. No. 4,369,441. While providing for high resolution displays, a principal disadvantage of the prior known apparatus is that the use of a DAC is relatively expensive and generally requires a considerable amount of space.

In another U.S. patent, U.S. Pat. No. 4,032,768, there is shown and described a stroke type display in which simultaneous $\Delta X$ and $\Delta Y$ step voltages are converted to variable rate ramp voltage pairs. A disadvantage of this display apparatus is that it requires the use of the non-linear properties of well-matched transistors.

The above discussion of CRT stroke type displays also applies to other types of stroke type displays, such as, for example, pen recorders.

Pen recorders also employ X and Y controls for controlling the movement of a pen along X and Y coordinates.

SUMMARY OF THE INVENTION

In view of the foregoing, principal objects of the present invention are a method and apparatus for generating strokes on a display which utilize relatively inexpensive digital components and require relatively little space compared to related prior known methods and apparatus.

Other objects of the present invention are a method and apparatus as described above which use a pair of charge pumps, or a pair of monostable multivibrators, each of which is responsive to the pulses in a pulse train applied thereto, for generating and transferring charge to or from an integrator coupled thereto. The aggregate amount of the charge generated and transferred to or from each integrator over the length of the pulse train is proportional to the length and direction of a stroke to be displayed while the rate of the charge transferred is such as to provide a stroke which is generated at a desired velocity.

Each stroke is comprised of an X and a Y component. In a preferred embodiment of the invention, there is provided for generating an analog signal corresponding to each of said X and Y components a pair of pulse train generators, a switch assembly, and an X and a Y charge pump and integrator assembly. The two pulse train generators are provided for generating two pulse trains for each stroke. The first pulse train, which is generated using a clock driven counter, is proportional to the absolute magnitude of the greater of the X and Y components of the stroke. The second pulse train, which is generated using a clock driven rate generator, is proportional to the absolute value of the ratio of the lesser of the X and Y components of the stroke to the greater of the X and Y components of the stroke.

One of the charge pumps and the integrator coupled thereto is provided for generating the X analog output signal to drive a horizontal or X display electrode or control in a display. The other charge pump and the integrator coupled thereto is provided for generating the Y analog output signal to drive a vertical or Y display electrode or control in the display.

Between the first and second pulse train generators and the X and Y charge pumps, there is provided the switch assembly. The switch assembly is provided for transferring the first pulse train to the charge pump and integrator assembly controlling the greater of the X and Y components of the stroke and the second pulse train to the charge pump and integrator assembly controlling the lesser of the X and Y components of the stroke.

In each charge pump and integrator assembly there is provided a means responsive to the pulse train applied to the charge pump for generating a charge and a means responsive to a control signal for selectively controlling whether the charge generated will be transferred to or from the integrator coupled to the charge pump. Accordingly, if the slope of the component of the stroke controlled by a charge pump and integrator assembly is positive, a first control signal will cause the charge to be transferred to the integrator. On the other hand, if the slope of said component is negative, a second control signal will cause the charge to be transferred from the integrator.

The rate at which the beam moves in response to the charge transferred to or from the integrators for each stroke, is a function of the pulse rate and the orientation of the stroke and varies from 1.0 times the rate for a stroke extending in the direction of one of the axes to 1.4 times said rate for a stroke extending in a direction 45° to one of the axes. In the context of the present invention, this rate is considered to be relatively constant in view of the efficient manner and means used for generating the strokes.

In another embodiment of the present invention there is provided for use in place of each of the described charge pumps a circuit responsive to a pulse train and control signals for selectively applying two predetermined voltages for a predetermined period to a voltage integrator having an output. In this embodiment there is provided a monostable multivibrator which is responsive to the pulse train for providing corresponding pulses having said predetermined period. The pulses from the monostable multivibrator are then used in conjunction with the control signals for controlling a switching means for selectively applying to the integrator a first potential and a second potential for said predetermined period to respectively increase and decrease the output of the integrator.

While essentially performing the same function as the previously described embodiment of the present invention, the latter embodiment has the advantage of being less dependent than the former embodiment on diodes, and less subject to problems associated with the transient response of an operational amplifier to a charge pulse input and problems associated with variable and matched capacitor characteristics.

BRIEF DESCRIPTION OF THE DRAWING

The above and other objects, features and advantages of the present invention will become apparent from the following detailed description of the accompanying drawing in which.

DETAILED DESCRIPTION OF THE DRAWING

Figure 1:
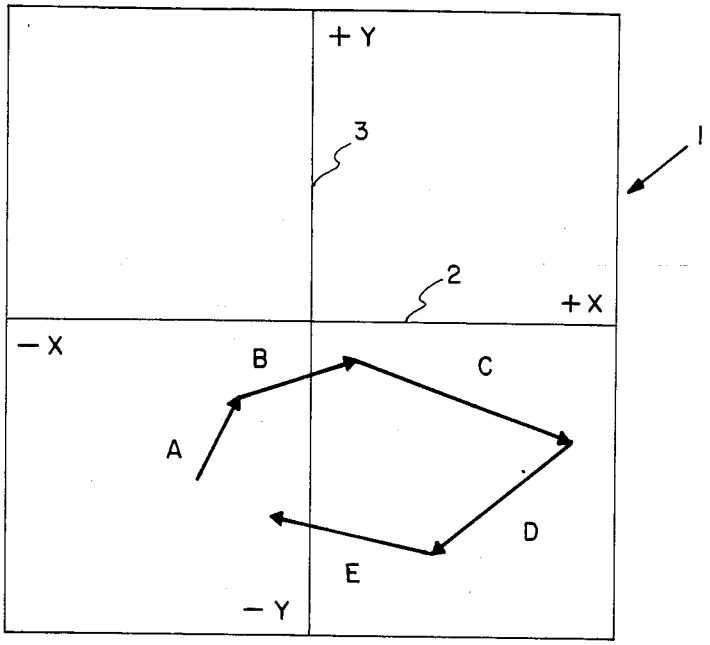
FIG. 1 is a diagram of a plurality of strokes comprising X and Y components of different magnitudes and polarities.

Referring to FIG. 1, there is shown a representation of a cathode ray tube (CRT) screen designated generally as 1. Superimposed on the screen 1 there is provided a coordinate system comprising a positive and negative X axis 2 and a positive and negative Y axis 3, each extending from the center of the screen 1. The junction of the X and Y axes 2, 3 in the center of the screen 1 represents a zero potential reference point for X and Y analog control signals which will be further described in detail below.

Drawn on the lower half of the screen 1 there is provided a plurality of vectors or strokes A, B, C, D and E. As described with respect to FIG. 2 below, the end points of each of the strokes A–E are defined by X and Y coordinates X1, Y1, and X2, Y2. The strokes A–E of FIG. 1 are shown connected in series to show how one might generate a graphic symbol, alphanumeric character or the like. It should be understood, however, that nothing in the present invention requires that any two vectors be connected.

As shown in FIG. 1, each of the strokes comprises a positive or negative X component and a positive or negative Y component. For example, considering each of the strokes as being generated in the direction of the arrow associated therewith, the A stroke comprises a positive X component and a positive Y component; the B stroke comprises a positive X component and a positive Y component; the C stroke comprises a positive X component and a negative Y component; the D stroke comprises a negative X component and a negative Y component; the E stroke comprises a negative X component and a positive Y component. For convenience, the magnitude of the X and Y components of each of the strokes is defined as follows:

$$\Delta X = X2 - X1$$

$$\Delta Y = Y2 - Y1$$

Figure 2:
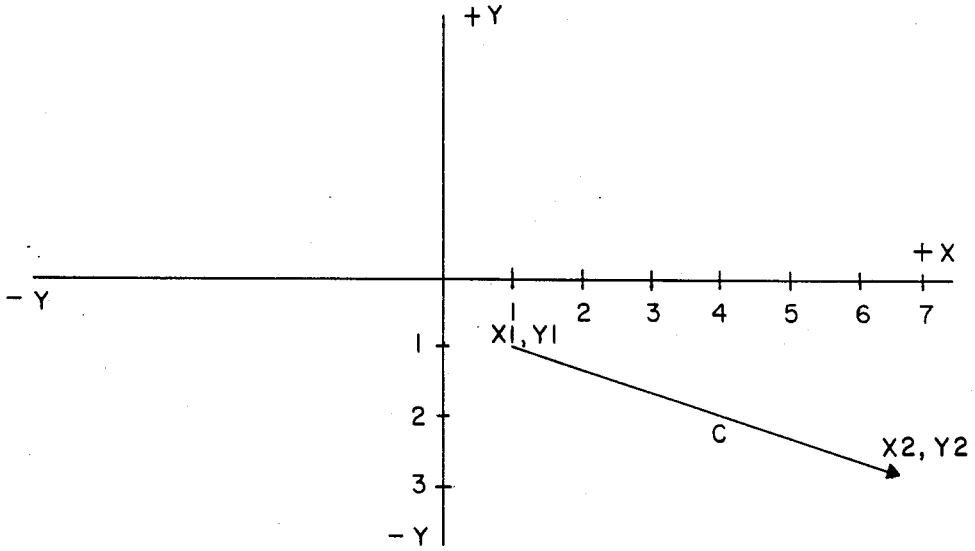
FIG. 2 is a diagram of the stroke C of FIG. 1 having a positive X component and a negative Y component with the magnitude of the X component being larger than the magnitude of the Y component.

Referring to FIG. 2, there is shown an enlarged diagram of the stroke C of FIG. 1. As shown in FIG. 2, stroke C has a positive X component equal to $7-1$ units and a negative Y component equal to $(-3)-(-1)$ units such that $\Delta X=6$ units, $\Delta Y=-2$ units, $|\Delta X|=6$ and $|\Delta Y|=2$.

Figure 3:
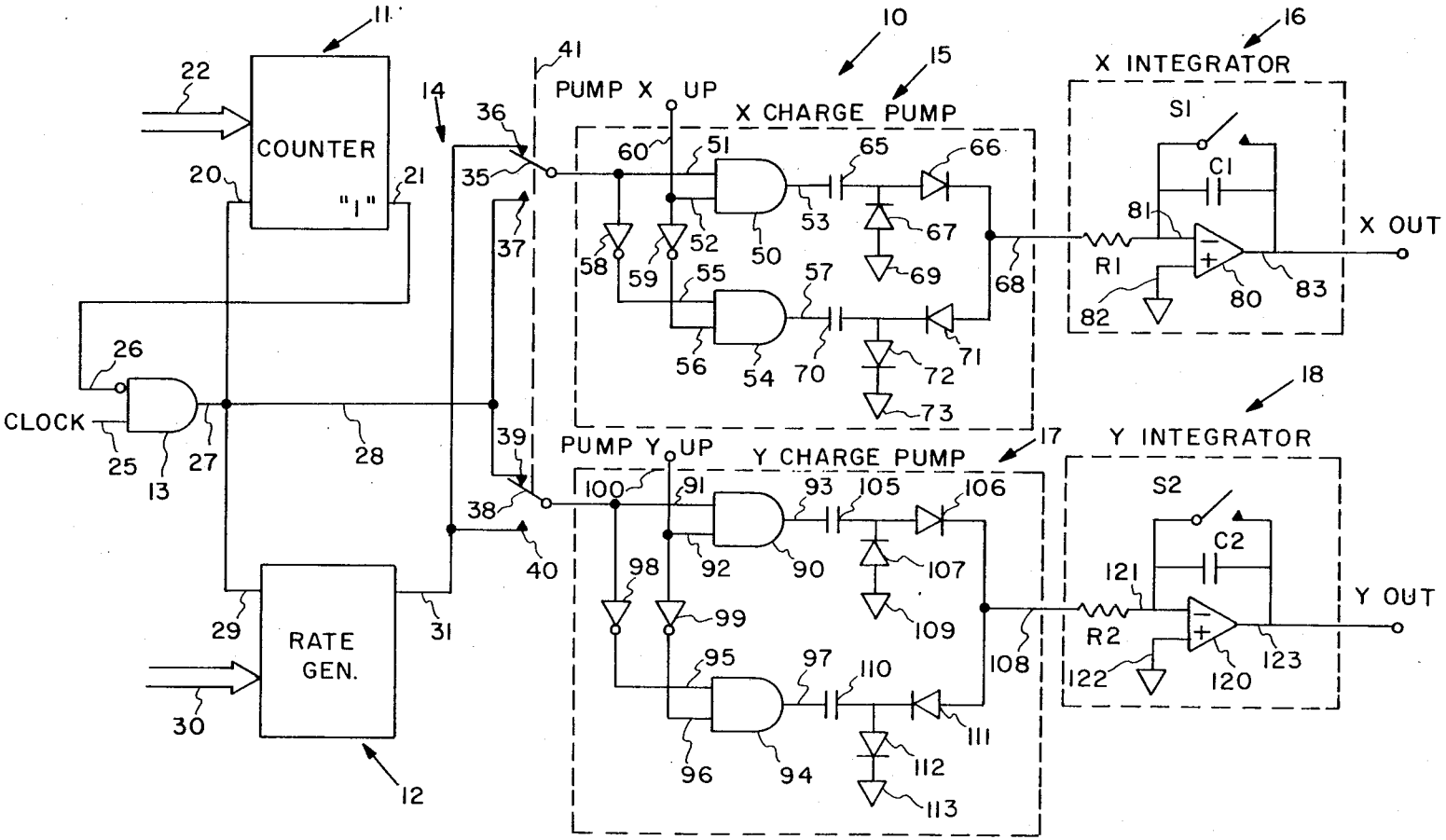
FIG. 3 is a block diagram of an embodiment of the present invention.

Referring to FIG. 3, there is provided in accordance with the present invention an apparatus designated generally as 10 for providing the X and Y analog output signals required for generating the strokes described above with respect to FIGS. 1 and 2.

In the apparatus 10 there is provided a counter designated generally as 11, a rate generator designated generally as 12, an AND gate 13, a double-pole switching assembly designated generally as 14, and X charge pump designated generally as 15, and X integrator designated generally as 16, a Y charge pump designated generally as 17, and a Y integrator designated generally as 18.

In the counter 11 there is provided a clock pulse input line 20, an output line 21 and a preset input bus 22.

In the gate 13 there is provided a true clock input line 25 which is provided for coupling the gate 13 to a source of clock pulses (not shown), an inverting input line 26 which is coupled to the output line 21 of the counter 11 and an output line 27 which is coupled to the clock input line 20 of the counter 11, the switch assembly 14 by means of a line 28 and a clock input line 29 of the rate generator 12.

In addition to the clock input line 29, there is provided in the rate generator 12 a preset bus 30 and an output line 31 coupled to the switch asembly 14.

In the switch assembly 14 there is provided a first pole 36 adapted to make contact with a pair of contacts 36 and 37, and a second pole 38 adapted to make contact with a pair of contacts 39 and 40. The contacts 36 and 40 are coupled in common to the output line 31 of the rate generator 12. The contacts 37 and 39 are coupled in common to the line 28 coupled to the output line 27 of the gate 13. A control mechanism, shown by the dashed line 41, is coupled to the poles 35 and 38 for switching the pole 35 between the contacts 36 and 37 and the pole 38 between the contacts 39 and 40 simultaneously.

In the X charge pump 15 there is provided an AND gate 50 having a pair of input lines 51 and 52 and an output line 53, an AND gate 54 having a pair of input lines 55 and 56 and an output line 57. The input line 51 of the AND gate 50 is coupled to the pole 35 of the switch assembly 14 and through an inverter 58 to the input line 55 of the AND gate 54. The input line 52 of the AND gate 50 is coupled through an inverter 59 to the input line 56 of the AND gate 54 and to an external source of X charge pump control signals (not shown) by means of a control signal input line 60. The output line 53 of the AND gate 50 is coupled through a capacitor 65 to the anode of a diode 66 and the cathode of a diode 67. The cathode of the diode 66 is coupled to an output line 68. The anode of the diode 67 is coupled to a source of reference potential by a line 69. The output line 57 and the AND gate 54 is coupled through a capacitor 70 to the cathode of a diode 71 and the anode of a diode 72. The anode of the diode 71 is coupled to the output line 68. The cathode of the diode 72 is coupled to the reference potential by a line 73.

In the integrator 16 there is provided an operational amplifier 80 having a pair of input lines 81 and 82 and an output line 83. The input line 81 is coupled through a resistor R1 to the output line 68 of the X charge pump 15 and to the output line 83 of the amplifier 80 through a capacitor C1. A normally open switch S1 is coupled in parallel with the capacitor C1. The input line 82 is coupled to the source of reference potential. The output line 83 is provided for coupling the X integrator 16 to the X electrode or other control circuit of a display apparatus.

In the Y charge pump 17 there is provided a two-input AND gate 90 having a first input line 91 and a second input line 92 and an output line 93, and a second two-input AND gate 94 having a first input line 95, a second input line 96 and an output line 97. The input line 91 of the AND gate 90 is coupled through an inverter 98 to the input line 95 of the AND gate 94 and to the pole 38 of the switch assembly 14. The input line 92 of the AND gate 90 is coupled through an inverter 99 to the input line 96 of the AND gate 94 and to an external source of Y charge pump control signals (not shown) by means of a control signal input line 100. The output line 93 of the AND gate 90 is coupled through a capacitor 105 to the anode of a diode 106 and the cathode of a diode 107. The cathode of the diode 106 is coupled to an output line 108. The anode of the diode 107 is coupled to the source of reference potential by means of a line 109. The output line 97 of the AND gate 94 is coupled through a capacitor 110 to the cathode of a diode 111 and the anode of a diode 112. The anode of the diode 111 is coupled to the output line 108. The cathode of the diode 112 is coupled to the source of reference potential by means of a line 113.

In the Y integrator 18 there is provided an operational amplifier 120 which has a first input line 121, a second input line 122 and an output line 123. The input line 121 is coupled through a resistor R2 to the output line 108 and through a capacitor C2 to the output line 123. The input line 122 is coupled to the source of reference potential. A normally open switch S2 is coupled in parallel with the capacitor C2. The output line 123 is provided for coupling the Y integrator 18 to the Y electrode or other control of a display apparatus (not shown).

In practice, to generate a stroke having an X component and a Y component, such as the stroke C shown in FIG. 2 and described above, an external apparatus (not shown) compares the magnitude and polarity of the X and Y components of the stroke to be displayed and generates a plurality of control signals and other inputs for use by the apparatus 10. For example, after comparing the magnitudes of the X and Y components of the stroke to be generated, the external apparatus generates a first and a second digital number. The first digital number corresponds to the larger of the X and Y components and is provided on the bus 22 of the counter 11 to preset the counter 11. The second digital number corresponds to the ratio of the magnitude of the lesser of the X and Y components to the greater of the X and Y components and is provided on the bus 30 of the rate generator 12 to preset the rate generator 12.

In addition to providing the first and second digital numbers on the busses 22 and 30, the external apparatus places a logical high on the control input line 60 of the X charge pump 15 when the X component of the stroke to be generated is positive and a high logical level on the control input line 100 of the Y charge pump 17 when the Y component of the stroke to be generated is positive. Conversely, if either or both of the X and Y components of the stroke to be generated is negative, the external apparatus places a low logical level on the appropriate control input 60 and/or 100.

In operation, after the counter 11 has been preset with the number corresponding to the absolute magnitude of the greater of the X and Y components of the stroke to be generated, the rate generator 12 has been preset with a number corresponding to the ratio of the lesser of the X and Y components and the greater of the X and Y components, a control level appropriate to the polarity of the X and Y components has been placed on the control lines 60 and 100, respectively, and the beam (if a cathode ray tube is used) or other display means, e.g. pen, has been moved to the starting position of a stroke by suitable reference potentials applied to their X, Y and Z control electrodes, clock pulses provided on the line 25 of the gate 13 are fed to the clock pulse inputs 20 and 29 of the counter 11 and the rate generator 12, respectively, and by means of the line 28 to the contacts 37 and 39 of the switch assembly 14. As the clock pulses are fed to the counter 11, the number in the counter 11 is changed from the value preset by the input on the bus 22 until such time as a logical high appears on the output line 21 which is coupled to one of the stages of the counter 11. When the logical high appears on the output line 21, it is inverted at the inverting input 26 of the gate 13 and disables the gate 13. The clock pulses appearing on the line 28 before the gate 13 is disabled provides a first pulse train comprising a number of pulses corresponding to the magnitude of the greater of the X and Y components of the stroke to be generated.

At the same time that the first pulse train is being generated at the output of the gate 13, a second pulse train, in response to the clock pulses on the line 29, is being generated by the rate generator 12 on its output line 31. While the first and second pulse trains are of equal length, the number of and interval between the pulses in the second pulse train differ from the number of pulses and interval between the pulses in the first pulse train in a manner corresponding to the number with which the generator 12 was preset, i.e., the ratio of the magnitudes of the X and Y components of the stroke being generated. For example, if the magnitude of one of the X and Y components is 50% of the magnitude of the other of the X and Y components, the number of pulses in the second pulse train will be 50% of the number of the pulses in the first pulse train and will be equally distributed over the length of the second pulse train. Similarly, if the magnitude of one of the X and Y components is one third of the magnitude of the other of the X and Y components, the number of the pulses in the second pulse train will be one third of the number of the pulses in the first pulse train and will be equally distributed over the length of the pulse train. It should be understood, however, that the examples given are merely illustrative of the operation of only one type of conventional rate generator and that other rate generators may be used which provide variable intervals between pulses.

As the first and second pulse trains are being generated on the lines 28 and 31, respectively, they are selectively transmitted to either the X charge pump 15 or the Y charge pump 17, depending on which of the X and Y components has the greatest magnitude. For example, if the magnitude of the X component of the stroke to be generated is larger than the magnitude of the Y component of the stroke, the control apparatus represented by the dashed line 41 in the external apparatus moves the poles 35 and 38 of the switch assembly 14 to make contact with the contacts 37 and 40, respectively. With the poles 35 and 38 in contact with the contacts 37 and 40, respectively, the first pulse train is fed to the X charge pump 15 and the second pulse train is fed to the Y charge pump 17. Conversely, if the Y component of the stroke to be generated is larger than the X component of the stroke, the poles 35 and 38 are placed in the position shown in FIG. 3, with the result that the first pulse train is directed to the Y charge pump 17 and the second pulse train is transmitted to the X charge pump 15.

Regardless of which one of the first and second pulse trains is transmitted to the X charge pump 15, if the X component of the stroke to be generated is positive, the control line 60 will be high, enabling the gate 50. With the gate 50 enabled, the pulse train transmitted to the X charge pump 15 will pass through the gate 50, the capacitor 65 and the diode 66 to the output line 68 and then to the X integrator 16. Because the pulse train applied to the gate 50 comprises a plurality of positive pulses, a charge corresponding to each pulse will be transmitted to the X integrator 16, increasing the analog output of the X integrator 16 on the output line 83. If, on the other hand, the X component of the stroke to be generated is negative, the control signal on the line 60 will drive the line 60 to a logical low, disabling the AND gate 50 and enabling the AND gate 54. The pulse train applied to the X charge pump 15 is then inverted by the inverter 58 and transmitted through the gate 54, the capacitor 70 and the diode 71 to the output line 68. Because of the arrangement of the diodes 71 and 72, the leading edge of the negative-going inverted pulses will transfer charge from the integrator 16 for each pulse applied to the gate 54, thereby decreasing the output on the line 83 of the X integrator 16. In any event, the output of the integrator 16 is linearly related to the pulse rate of the pulse train applied to the charge pump 15.

The Y charge pump 17 and integrator 18 function in precisely the same manner in response to high and low levels on the control line 100.

To compensate for inherent drift in the integrators 16 and 17, the control switches S1 and S2 in the integrators 16 and 17 are occasionally closed. The closing of these switches couples the input and the output of the operational amplifiers 80 and 120 and causes their output to return to the reference potential. For example, in one embodiment of the invention using a cathode ray tube, the reference potential is such that a visible beam would be centered on the tube.

Figure 4:
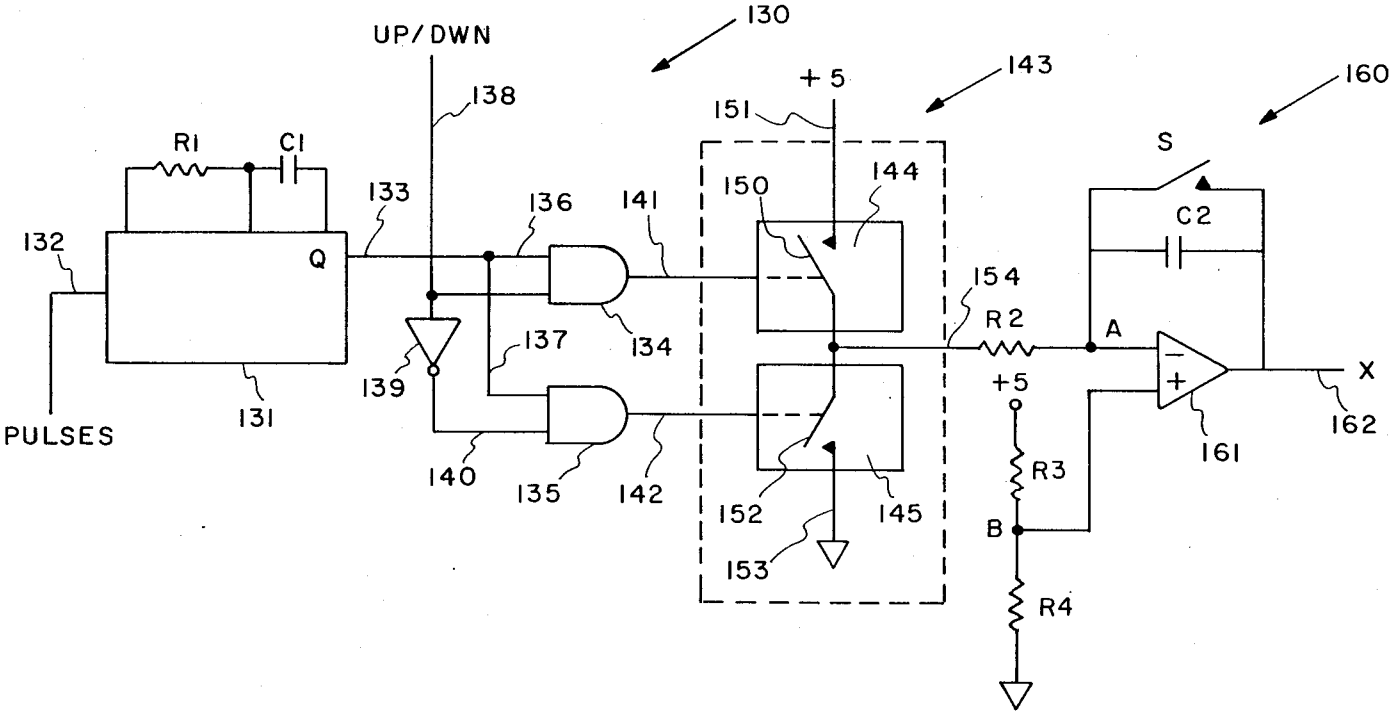
FIG. 4 is a partial block diagram of an alternative embodiment of the present invention.

Referring to FIG. 4, there is provided in an alternative embodiment of the present invention a circuit designated generally as 130. In a system using the alternative embodiment of the present invention, there actually will be provided two circuits 130. One of the circuits 130 will be provided for controlling the X axis of a graphic display and another of the circuits 130 will be provided for controlling the Y axis of the graphic display. Since both of the circuits 130 are substantially identical except for the signals being processed by them, it is necessary to describe only one of the circuits to obtain an understanding of how both are made and used. Accordingly, only the circuit for controlling the X axis of a graphic display as shown in FIG. 4 will be described.

In the circuit 130 there is provided a monostable multivibrator 131. The multivibrator 131 is provided with a resistor R1, a capacitor C1, an input line 132 for receiving a pulse train and an output line 133 coupled to one input of each of a pair of two input AND gates 134 and 135. The AND gate 134 is coupled to the output line 133 by means of an input line 136. The AND gate 135 is coupled to the output line 133 by means of an input line 137. Coupled to the second input of the AND gates 134 and 135 there is provided a source of up/-down control signals. The source of up/down control signals is coupled to the second input of the AND gate 134 by means of a line 138 and through an inverter 139 to the second input of the AND gate 135 by means of an input line 140. The AND gate 134 is provided with an output line 141. The AND gate 135 is provided with an output line 142. The output lines 141 and 142 are coupled to a switch assembly designated generally as 143 to control the switching thereof, as will be described below.

In the switch assembly 143 there is provided a pair of switches 144 and 145. In the switch assembly 144 there is provided a pole 150 for making contact with a line 151 coupled to a source of potential, e.g. +5 volts. The switch assembly 145 is provided with a pole 152 for making contact with a line 153 coupled to a second source of potential, e.g. a ground potential. The poles 150 and 152 are coupled in common by means of a line 154 to an integrating circuit designated generally as 160.

In the integrating circuit 160 there is provided a resistor R2. The resistor R2 couples the line 154 to a summing input designated as node A of an operational amplifier 161 which has an output line 162. Coupled between the node A and the output line 162 there is provided a capacitor C2. Coupled in parallel with the capacitor C2 there is provided a normally open switch S. The switch S is closed occasionally to compensate for circuit drift as described above with respect to the switches S1 and S2 of FIG. 3. Coupled to a reference input, designated as node B, of the amplifier 161 there is provided a voltage dividing circuit comprising a pair of matched resistors R3 and R4. The resistor R3 is coupled to a source of potential, e.g. +5 volts, and by means of the node B to the resistor R4 which is in turn coupled to ground.

It should be understood that the above description of the switch assembly 143 is simplified for purposes of illustrating the present invention and that in practice the switches 144 and 145 could comprise a variety of switching means such as a tristate logic gate or a pair of field-effect transistors.

In operation, a pulse train comprising a plurality of pulses having a predetermined pulse rate are applied to the input line 132 of the multivibrator 131. In response to the leading edge of each of the pulses applied to the input line 132, the multivibrator 131 outputs on the line 133 a corresponding pulse. The period of the corresponding pulse on the line 133 is determined by the values of the resistor R1 and the capacitor C1. Preferably, the values of the resistor R1 and the capacitor C1 are chosen such that the corresponding pulses on the output line 133 are almost as long as the shortest pulse intervals applied to the input line 132.

As the corresponding pulses are generated on the output line 133, the corresponding pulses are fed through either the gate 134 or the gate 135, depending on the condition of the up/down control signal applied to the line 138. If the line 138 is high, the pulses on the line 133 are fed to the output line 141 of the gate 134. If the control line 138 is low, the pulses on the output line 133 are fed through the gate 135 to the output line 142.

The pulses on the lines 141 and 142 control the opening and the closing of the poles 150 and 152, respectively. That is to say, in response to a pulse on the line 141, the pole 150 in the switch 144 is closed for the period of the pulse. When the pole 150 is closed, a potential of +5 volts is coupled to the summing input node A through the resistor R2. Conversely, when a pulse exists on the line 142, the pole 152 is closed for the period of the pulse causing the node A to be coupled through the resistor R2 to ground. In the absence of a pulse on the lines 141 and 142, the associated poles 150 and 152 are open. However, as described above, in practice, the switching functions may be provided by conventional solid-state devices, e.g. FETS.

With +5 volts across the resistors R3 and R4, the node B coupled to the reference input of the operational amplifier 161 is 2.5 volts. In accordance with the conventional operation of the circuit 160, the node A is maintained at said reference potential of 2.5 volts. Thus, if a +5 volt potential is applied to the line 154 coupled to the resistor R2 by the closing of the pole 150 of the switch 144, there is a tendency for the potential on the node A to rise. However, due to the operation of the amplifier 161, the amplifier 161 causes the potential on the output line 162 to decrease by a proportionate amount while the capacitor C2 is charged in order to maintain the node A at the reference potential of 2.5 volts. Conversely, if the pole 152 of the switch 145 is closed coupling the node A to ground, the potential on the output line 162 of the amplifier 161 increases while the capacitor C2 discharges to maintain the potential at node A at the reference potential of 2.5 volts.

In practice, the change in the magnitude of the potential on the output line 162 of the amplifier 161, whether negative or positive, occurs at a rate which is linearly related to the pulse rate of the pulses applied to the input line 132 of the multivibrator 131. Moreover, if the corresponding pulses generated on the line 133 have a nearly 100% duty cycle, the change in the magnitude of the potential on the output line 162 of the amplifier 161 is relatively smooth.

While preferred embodiments of the invention are described above, it is contemplated that various changes and modifications may be made thereto without departing from the spirit and scope of the present invention. For example, instead of using a counter for generating the first pulse train, a suitably programmed and controlled rate generator may be used. Instead of using a mechanical switch assembly such as the assemby 14, a digital switch assembly may be used for transmitting the first and second pulse trains to the X and Y charge pumps 15 and 17. Instead of using a switch assembly of any type, the necessary pulse trains may be generated in a pulse train source which is permanently coupled to a particular one of the charge pumps. For these reasons, the scope of the present invention should not be limited to the embodiments disclosed and suggested but rather be determined by reference to the claims hereinafter provided.

What is claimed is:

1. An apparatus for generating a stroke having an X and a Y component on a display comprising:

means for providing a first pulse train having a first pulse rate;

means for providing a second pulse train having a second pulse rate; and means responsive to said first and said second pulse trains for providing a first and a second output corresponding to said X and said Y components, respectively, each of whose rate of change is linearly related to a different one of said first and said second pulse rates.

2. An apparatus according to claim 1 wherein said first and said second outputs are subject to drifting relative to a predetermined reference potential and said means for providing said first and said second output comprises means for setting said first and said second outputs to a predetermined potential relative to said reference potential.

3. An apparatus according to claim 1 wherein said means for providing said first and said second output comprises integrating means for providing said first and said second outputs.

4. An apparatus according to claim 3 wherein said means for providing said first and said second output comprises a first and a second charge pump which are responsive to said first and said second pulse trains for providing a first and a second charge corresponding to said X and said Y components, respectively, and said integrating means is responsive to said first and said second charges for providing said first and said second outputs, respectively.

5. An apparatus according to claim 1 wherein said means for providing said first and said second output is responsive to said first and said second pulse trains for providing a first and a second plurality of charges corresponding to said X and said Y components, respectively, wherein the number of charges in each of said plurality of charges is linearly related to the number of pulses in said first and said second pulse trains, respectively.

6. An apparatus according to claim 5 wherein said means for providing said first and said second output comprises integrating means coupled to said first and said second charge providing means for providing said first and said second outputs.

7. An apparatus according to claim 1 wherein at least one of said first and said second pulse train providing means comprises a counting means.

8. An apparatus according to claim 1 wherein at least one of said first and said second pulse train providing means comprises a rate generator means.

9. An apparatus according to claim 1 wherein said first pulse train providing means comprises a counting means and said second pulse train providing means comprises a rate generator means.

10. An apparatus according to claim 1 wherein said first pulse train providing means comprises:

a counter having an input for receiving clock pulses, an input for presetting said counter and an output for providing a gate enable signal when said counter contains other than a predetermined number; and a gate means having an input for coupling to a source of clock pulses, an input coupled to said counter output and an output coupled to said counter clock pulse input and said selective pulse train transferring means which is responsive to said gate enable signal for transferring clock pulses from said source to said counter clock pulse input and said selective pulse train transferring means, said clock pulses forming said first pulse train.

11. An apparatus according to claim 1 wherein said second pulse train providing means comprises:

a counter having an input for receiving clock pulses, an input for presetting said counter and an output for providing a gate enable signal when said counter contains other than a predetermined number;

a gate means having an input for coupling to a source of clock pulses, an input coupled to said counter output and an output coupled to said counter clock pulse input and a rate generator clock pulse input, which is responsive to said gate enable signal for transferring clock pulses from said source to said rate generator clock pulse input; and a rate generator having said rate generator clock pulse input, an input for presetting said rate generator and an output, which is responsive to the clock pulses received from said gate means for transferring a predetermined number of said clock pulses to said selective pulse train transferring means, said predetermined number of said clock pulses forming said second pulse train.

12. An apparatus according to claim 1 wherein said first and said second output providing means comprises:

a first charge pump;

a second charge pump;

means for selectively transferring said first pulse train to said first charge pump and said second pulse train to said second charge pump in response to a first control input and said first pulse train to said second charge pump and said second pulse train to said first charge pump in response to a second control input;

a first integrating means coupled to said first charge pump;

a second integrating means coupled to said second charge pump; and means in each of said charge pumps for selectively transferring to the integrating means coupled thereto in response to a first control signal and from the integrating means coupled thereto in response to a second control signal, a predetermined charge for each pulse transferred to said charge pump from said first and said second pulse train providing means.

13. An apparatus according to claim 12 wherein each of said first and said second charge pumps comprises:

a first gate;

a second gate;

a first inverter;

a second inverter;

a first capacitor;

a second capacitor;

a first diode;

a second diode;

a third diode;

a fourth diode;

means for coupling said selective pulse train transferring means to a first input of said first gate and through said first inverter to a first input of said second gate;

means for coupling a control signal to a second input of said first gate and through said second inverter to said second input of said second gate;

means for coupling an output of said first gate through said first capacitor and said first diode to one of said integrating means;

means for coupling said second diode between a node located between said first capacitor and said first diode and a reference potential, said anode of said first diode and said cathode of said second diode being coupled to said nodes;

means for coupling an output of said second gate through said second capacitor and said third diode to said one of said integrating means; and means for coupling said fourth diode between a node located between said second capacitor and said third diode and a reference potential, said cathode of said third diode and said anode of said fourth diode being coupled to said node.

14. An apparatus according to claim 12 wherein each of said first and said second integrating means comprises:

an amplifier;

a capacitor coupled between an input and an output of said amplifier;

a resistor for coupling said input of said amplifier to one of said charge pumps; and means coupled in parallel with said capacitor for selectively shorting said capacitor.

15. A method of generating a stroke having X and Y components on a display comprising the steps of:

providing a first and a second pulse train having a first and a second pulse rate, respectively;

selectively generating and transferring a charge for each pulse in one of said first and said second pulse trains to a first analog signal generating means in response to a first control signal and from said first analog signal generating means in response to a second control signal for providing an analog signal at the output of said first analog signal generating means having a magnitude which varies linearly as a function of said pulse rate in said one pulse train; and selectively generating and transferring a charge for each pulse in the other of said first and said second pulse trains to a second analog signal generating means in response to a third control signal and from said second analog signal generating means in response to a fourth control signal for providing an analog signal at the output of said second analog signal generating means having a magnitude which varies linearly as a function of the pulse rate in said other pulse train.

16. A method according to claim 15 wherein said step of providing a first pulse train comprises the step of providing a pulse train which corresponds to the absolute value of the greater of said X and Y components and said step of providing said second pulse train comprises the step of providing a pulse train which corresponds to the ratio of the absolute value of the lesser of said X and Y components and to the absolute value of the greater of said X and Y components.

17. A method according to claim 15 comprising the steps of:

providing said first control signal when the magnitude of said X component is positive;

providing said second control signal when the magnitude of said X component is negative;

providing said third control signal when the magnitude of said Y component is positive; and providing said fourth control signal when the magnitude of said Y component is negative.

18. An apparatus for generating a stroke between two pairs of coordinates X1, Y1 and X2, Y2 on a display comprising:

a first means responsive to a plurality of signals proportional to the magnitude and polarity of $\Delta X$ and $\Delta Y$ for providing an X analog output signal having a magnitude which increases at a first rate when $|\Delta X|>|\Delta Y|$ and $\Delta X>0$;

a second means responsive to a plurality of signals proportional to the magnitude and polarity of $\Delta X$ and $\Delta Y$ for providing an X analog output signal having a magnitude which increases at a second rate, when $|\Delta X|<|\Delta Y|$ and $\Delta X>0$;

a third means responsive to a plurality of signals proportional to the magnitude and polarity of $\Delta X$ and $\Delta Y$ for providing an X analog output signal having a magnitude which decreases at said first rate when $|\Delta X|>|\Delta Y|$ and $\Delta X<0$;

a fourth means responsive to a plurality of signals proportional to the magnitude and polarity of $\Delta X$ and $\Delta Y$ for providing an X analog output signal having a magnitude which decreases at said second rate when $|\Delta X|<|\Delta Y|$ and $\Delta X<0$;

a fifth means responsive to a plurality of signals proportional to the magnitude and polarity of $\Delta X$ and $\Delta Y$ for providing a Y analog output signal having a magnitude which increases at a third rate, when $|\Delta X|<|\Delta Y|$ and $\Delta Y>0$;

a sixth means responsive to a plurality of signals proportional to the magnitude and polarity of $\Delta X$ and $\Delta Y$ for providing a Y analog output signal having a magnitude which increases at a fourth rate, when $|\Delta X|>|\Delta Y|$ and $\Delta Y>0$;

a seventh means responsive to a plurality of signals proportional to the magnitude and polarity of $\Delta X$ and $\Delta Y$ for providing a Y analog output signal having a magnitude which decreases at said third rate when $|\Delta X|<|\Delta Y|$ and $Y=$;

an eighth means responsive to a plurality of signals proportional to the magnitude and polarity of $\Delta X$ and $\Delta Y$ for providing a Y analog output signal having a magnitude which decreases at said fourth rate when $|\Delta X|<|\Delta Y|$ and $Y<0$, where $\Delta X=X2-X1$, $\Delta Y=Y2-Y1$ and $|X|$ and $|Y|$ are the absolute values of $\Delta X$ and $\Delta Y$, respectively.

19. An apparatus according to claim 18 wherein said X and Y analog output signal providing means comprises:

an X charge pump having an input and an output coupled to an input of an X integrating means, said X integrating means having an output for providing said X analog output signals a Y charge pump having an input and an output coupled to an input of a Y integrating means, said Y integrating means having an output for providing said Y analog output signals; and means disposed in each of said X and Y charge pumps which is responsive to a control signal and a first and a second signal applied to said inputs of said X and Y charge pumps, respectively, for selectively increasing and decreasing from a predetermined reference potential the magnitude of each of said X and Y analog output signals at a rate proportional to one of said first, said second, said third and said fourth rates.

20. An apparatus according to claim 19 comprising first and second means, each having an output for providing said first and said second signals, respectively; and means for selectively coupling the outputs of said first and said second signal providing means to said inputs of said X and said Y charge pumps, wherein each of said first and said second signals comprises a first and second pulse train, respectively.

21. An apparatus according to claim 20 wherein said first signal providing means comprises means responsive to a signal which is proportional to the greater of $|X|$ and $|Y|$ for providing said first pulse train and said second signal providing means comprises a means responsive to a signal which is proportional to the ratio of the lesser of $|X|$ and $|Y|$ and the greater of $|X|$ and $|Y|$ for providing said second pulse train.

22. An apparatus for generating a stroke having an X and a Y component on a display comprising:

means for integrating a charge;

means responsive to each pulse in a pulse train for providing a train of corresponding pulses having a pulse rate and a predetermined period; and means responsive to a first and a second control signal and said corresponding pulses for selectively applying a first and a second predetermined potential to said charge integrating means for said predetermined period for each one of said pulses for changing said charge at a rate which is linearly related to said pulse rate.

23. An apparatus according to claim 22 wherein said charge integrating means comprises an operational amplifier having a summing input and an output and said first and said second predetermined potential applying means comprises means responsive to said first control signal for applying said first predetermined potential to said input for increasing said output and means responsive to said second control signal for applying said second predetermined potential to said input for decreasing said output.

* * * * *

UNITED STATES PATENT AND TRADEMARK OFFICE

CERTIFICATE OF CORRECTION

PATENT NO. : 4,686,642

DATED : August 11, 1987

INVENTOR(S) : JAMES L. BUXTON et al

It is certified that error appears in the above-identified patent and that said Letters Patent is hereby corrected as shown below:

Column 5, line 2, change "36" to --35--.

Column 13, line 68, change "Y=" to --$\Delta Y<0$--.

Column 14, line 5, change "$|\Delta X|<|\Delta Y|$ and $Y<0$" to --$|\Delta X|>|\Delta Y|$ and $\Delta Y<0$--.

Signed and Sealed this

Twenty-ninth Day of December, 1987

*Attest:*

DONALD J. QUIGG

*Attesting Officer*

*Commissioner of Patents and Trademarks*